US011493252B2

(12) United States Patent
Olvera et al.

(10) Patent No.: US 11,493,252 B2
(45) Date of Patent: Nov. 8, 2022

(54) ICE MAKER ASSEMBLY FOR A COOLING DEVICE

(71) Applicant: Electrolux Home Products, Inc., Charlotte, NC (US)

(72) Inventors: Jose Carlos Trejo Olvera, Belton, SC (US); Matthew Edge, Anderson, SC (US); Marcello Machado, Anderson, SC (US); Thomas McCollough, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 10 days.

(21) Appl. No.: 16/916,506

(22) Filed: Jun. 30, 2020

(65) Prior Publication Data

US 2021/0404725 A1 Dec. 30, 2021

(51) Int. Cl.
*F25C 1/25* (2018.01)
*F25C 1/04* (2018.01)

(52) U.S. Cl.
CPC ..... *F25C 1/25* (2018.01); *F25C 1/04* (2013.01); *F25C 2400/10* (2013.01); *F25C 2400/14* (2013.01)

(58) Field of Classification Search
CPC ..... F25C 1/04; F25C 1/25; F25C 2400/10; F25C 2400/14
See application file for complete search history.

(56) References Cited

U.S. PATENT DOCUMENTS 6,351,955 B1 3/2002 Oltman et al.
6,438,988 B1 8/2002 Paskey
6,708,509 B1 3/2004 Senner
6,964,177 B2 11/2005 Lee et al.
7,222,497 B2 5/2007 An et al.
7,472,552 B2 1/2009 An et al.
7,610,772 B2 11/2009 Braun et al.
7,757,511 B2 7/2010 LeClear et al.
(Continued)

FOREIGN PATENT DOCUMENTS

EP 2604959 6/2013
KR 20160148969 12/2016
(Continued)

OTHER PUBLICATIONS

International Search Report for PCT/US2021/038611, dated Dec. 7, 2021, 21 pages.
(Continued)

*Primary Examiner* — Elizabeth J Martin
(74) *Attorney, Agent, or Firm* — Pearne & Gordon LLP

(57) ABSTRACT

A cooling device including a liner defining a freezer compartment, a shelf positioned within the freezer compartment, and an ice maker assembly secured to the shelf. The ice maker assembly including an ice maker configured to produce ice pieces, and an ice maker support frame that supports the ice maker. The ice maker support frame includes a fill cup and an air plenum, the air plenum defining a channel therein and extends between first and second walls of the ice maker support frame. A fan is disposed adjacent the ice maker frame at a location corresponding to the air plenum. The fill cup is configured to receive water from a water fill tube and direct the water to an ice tray of the ice maker.

20 Claims, 7 Drawing Sheets

(56) References Cited

U.S. PATENT DOCUMENTS

| | | | | |
|---|---|---|---|---|
| 8,479,533 | B2 | 7/2013 | Chase et al. | |
| 8,534,089 | B2 | 9/2013 | An et al. | |
| 8,627,677 | B2 | 1/2014 | Anell et al. | |
| 8,650,901 | B2 | 2/2014 | Gottschling et al. | |
| 8,733,122 | B2 | 5/2014 | Lim et al. | |
| 8,844,310 | B2 | 9/2014 | Chase et al. | |
| 9,377,233 | B2 | 6/2016 | Boehringer et al. | |
| 9,518,774 | B2 | 12/2016 | Miller | |
| 9,625,200 | B2 | 4/2017 | Gu et al. | |
| 10,393,421 | B2 | 8/2019 | Lee et al. | |
| 10,739,053 | B2 * | 8/2020 | Jimenez | F25C 1/04 |
| 2006/0266055 | A1 | 11/2006 | Anderson | |
| 2011/0252816 | A1 | 10/2011 | Kulkarni et al. | |
| 2016/0282028 | A1 | 9/2016 | Boehringer et al. | |
| 2018/0231294 | A1 * | 8/2018 | Song | F25C 1/04 |
| 2019/0003758 | A1 * | 1/2019 | Scalf | F25D 17/045 |
| 2019/0108824 | A1 | 4/2019 | Drotleff et al. | |
| 2019/0145686 | A1 * | 5/2019 | Kim | F25C 1/24 62/344 |
| 2019/0331396 | A1 * | 10/2019 | Choi | F25C 1/04 |
| 2020/0033040 | A1 * | 1/2020 | Bertolini | F25C 5/187 |
| 2020/0109886 | A1 | 4/2020 | Shi | |
| 2020/0124331 | A1 * | 4/2020 | Harata | F25C 1/04 |

FOREIGN PATENT DOCUMENTS

| | | | |
|---|---|---|---|
| WO | 2016037909 | 3/2016 | |
| WO | WO-2016037909 A1 * | 3/2016 | F25C 1/24 |

OTHER PUBLICATIONS

International Search Report for PCT/US2021/038611, dated Oct. 13, 2021, 2 pages.

* cited by examiner

ICE MAKER ASSEMBLY FOR A COOLING DEVICE

FIELD OF THE INVENTION

This application relates generally to an ice maker assembly for a cooling device, and more particularly, an ice maker assembly secured to a shelf located within a freezer compartment, wherein the ice maker assembly includes an ice maker support frame having a fill cup and an air plenum.

BACKGROUND OF THE INVENTION

Conventional cooling devices, such as domestic refrigerators/freezers, typically have ice makers that produce ice pieces for user consumption. Such ice makers are generally located at an upper corner within a compartment of the refrigerator/freezer. This placement promotes quick and efficient installation as there are several supports (e.g., the walls of the compartment) to anchor the ice maker. Relocating the ice maker from this position presents several design challenges.

First, new anchoring points must be found, as the ice maker will no longer be disposed at a corner (i.e., an intersection of three perpendicular walls) of the compartment. The chosen relocated position not only needs to be able to support a weight of the ice maker, it also must maintain a proper aesthetic appearance of the compartment.

Further, because the ice maker is being repositioned at a location away from a top wall of the compartment, a redesign of the water fill tube routing system is required. That is, conventional refrigeration appliances often have water fill tubes that route water from a downstream source to the ice maker, wherein an outlet end of the water fill tube penetrates the top wall of the compartment. Relocating the ice maker thus requires relocation of the water fill tube. This increases the total number of parts of the appliance as well as its overall complexity.

Finally, conventional ice makers installed at an upper corner of a compartment generally receive a flow of freshly chilled air guided directly from an evaporator. Relocating the ice maker to a different position requires a redesign of how cool air is guided to the ice maker. Further, if the ice maker (at the relocated position) is not capable of receiving freshly chilled air, then a solution must be found to increase productivity of the ice maker.

BRIEF SUMMARY OF THE INVENTION

In accordance with one aspect, there is provided an ice maker assembly for a cooling device. The ice maker assembly comprises an ice maker configured to produce ice pieces. The ice maker includes an ice tray. An ice maker support frame supports the ice maker. The ice maker support frame includes a fill cup and an air plenum. The fill cup is configured to guide water from an upstream source to the ice tray and includes a slide extending to an area disposed above the ice tray. The air plenum defines a channel therein and extends between first and second walls of the ice maker support frame. The ice maker assembly further includes a fan disposed adjacent the ice maker support frame at a location corresponding to the air plenum. The fan is located at a position downstream from the ice maker with respect to an air flow generated by the fan.

In accordance with another aspect, there is provided a cooling device comprising a liner defining a freezer compartment. A shelf is disposed within the freezer compartment and has a storage surface and a support surface. The storage surface is configured to receive and support food items thereon, and the support surface faces a direction opposite from that of the storage surface. An ice maker assembly is secured to the support surface of the shelf. The ice maker assembly includes an ice maker configured to produce ice pieces and an ice maker support frame that supports the ice maker. The ice maker support frame includes a fill cup and an air plenum. The ice maker support frame is attached to the support surface of the shelf.

In accordance with yet a further aspect, there is provided a cooling device comprising a liner defining a freezer compartment. The liner includes a top wall, a bottom wall, a rear wall, and a pair of opposing side walls. A cover is disposed adjacent the rear wall of the liner and extends between the top wall and the bottom wall of the liner. An air guide is defined as a space between the cover and the rear wall of the liner.

An evaporator is disposed within the air guide. A first fan is also disposed within the air guide at a location vertically above the evaporator. The first fan directs freshly chilled air, cooled by the evaporator, through the air guide and into a central area of the freezer compartment where the freshly chilled air mixes with used air already present in the central area. The cooling device further includes a water fill tube configured to guide water therein. The water fill tube extends through a selected one of the pair of opposing side walls of the liner. A shelf is disposed within the freezer compartment and extends between the opposing side walls of the liner. The shelf has a storage surface and a support surface. The storage surface is configured to receive and support food items for storage.

An ice maker assembly is secured to the support surface of the shelf. The ice maker assembly comprises an ice maker configured to produce ice pieces. The ice maker includes an ice tray and a housing that at least partially surrounds the ice tray. The housing includes a top wall and a pair of guide surfaces. The top wall is located above the ice tray and has an opening formed therein. The pair of guide surfaces are disposed adjacent respective sides of the ice tray.

An ice maker support frame is attached to the support surface of the shelf. The ice maker support frame includes a bottom wall, a rear wall, an air plenum, and a fill cup. The fill cup is configured to receive water from the water fill tube and guide the water to the ice tray. The air plenum defines a channel therein that extends between an inlet opening formed in the bottom wall of the ice maker support frame and an outlet opening formed in the rear wall of the ice maker support frame. The top wall of the housing is attached to the bottom wall of the ice maker support frame such that the opening of the housing is aligned with the inlet opening. A second fan is disposed at the outlet opening. The second fan generates a suction force during operation such that a flow of the used air is drawn through the ice maker, into the channel of the air plenum via the inlet opening, and received by the fan via the outlet opening.

DESCRIPTION OF EXAMPLE EMBODIMENTS

Figure 1:
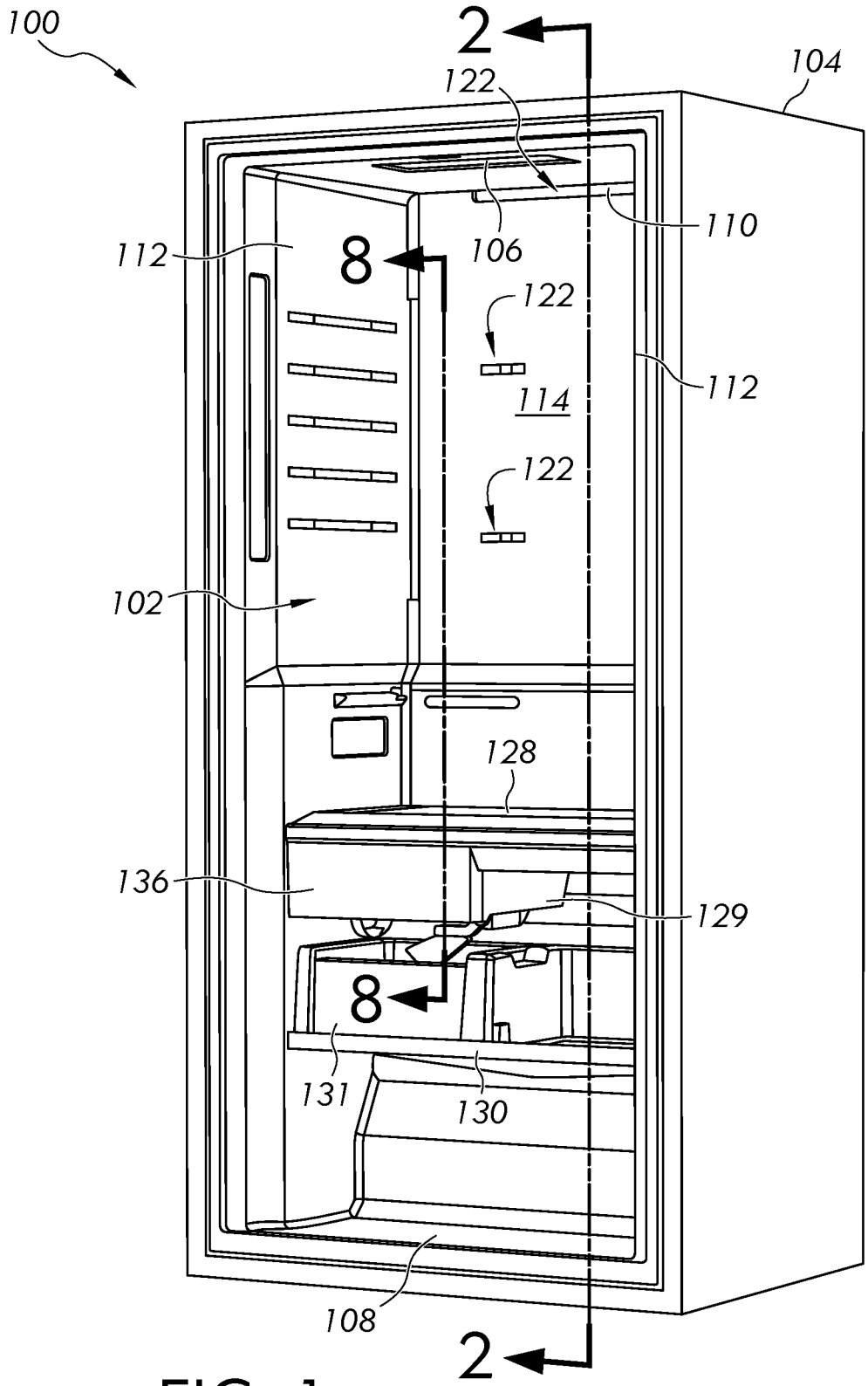
FIG. 1 is a front perspective view of a cooling device with a door thereof removed.

Referring now to the drawings, FIG. 1 shows a cooling device, which may include various types of refrigeration appliances in the form of a domestic refrigerator or a domestic freezer, indicated generally at 100. Although the detailed description that follows concerns a domestic freezer 100, the invention can be embodied by refrigeration appliances other than a domestic freezer 100. Further, an embodiment is described in detail below and shown in the figures as a single compartment freezer 100, defining a freezer compartment 102 therein. It is to be understood that other configurations are contemplated, for example, a single compartment refrigerator, defining a fresh food compartment therein, a bottom-mount refrigerator, including a fresh food compartment disposed vertically above a freezer compartment, a top-mount refrigerator (i.e., fresh food compartment disposed vertically below the freezer compartment), a side-by-side refrigerator (i.e., fresh food compartment disposed laterally adjacent the freezer compartment), a French-door bottom-mount refrigerator, refrigerators including variable climate zone compartments, etc.

While not shown, one or more doors can be pivotally coupled to the freezer 100 to restrict and grant access to the freezer compartment 102. The door(s) can include a single door that spans the entire lateral distance across the entrance to the freezer compartment 102, or can include two or more vertically stacked doors that provide access to a sub-portion of the single freezer compartment 102, or can include a pair of French-type doors that collectively span the entire lateral distance of the entrance to the freezer compartment 102 to enclose the freezer compartment 102.

Further, a drawer assembly (not shown) including one or more freezer baskets (not shown) can be withdrawn from the freezer compartment 102 to grant a user access to food items stored in the freezer compartment 102. The drawer assembly can be coupled to a freezer door that includes a handle. When a user grasps the handle and pulls the freezer door open, at least one or more of the freezer baskets is caused to be at least partially withdrawn from the freezer compartment 102.

The freezer compartment 102 is used to freeze and/or maintain articles of food stored therein in a frozen condition. For this purpose, the freezer compartment 102 is in thermal communication with an evaporator 124 (shown in FIG. 2, and discussed below) that removes thermal energy from the freezer compartment 102 to maintain the temperature therein at a temperature of 0° F. or less during operation of the freezer 100, preferably between −10° F. and 10° F.

Figure 6:
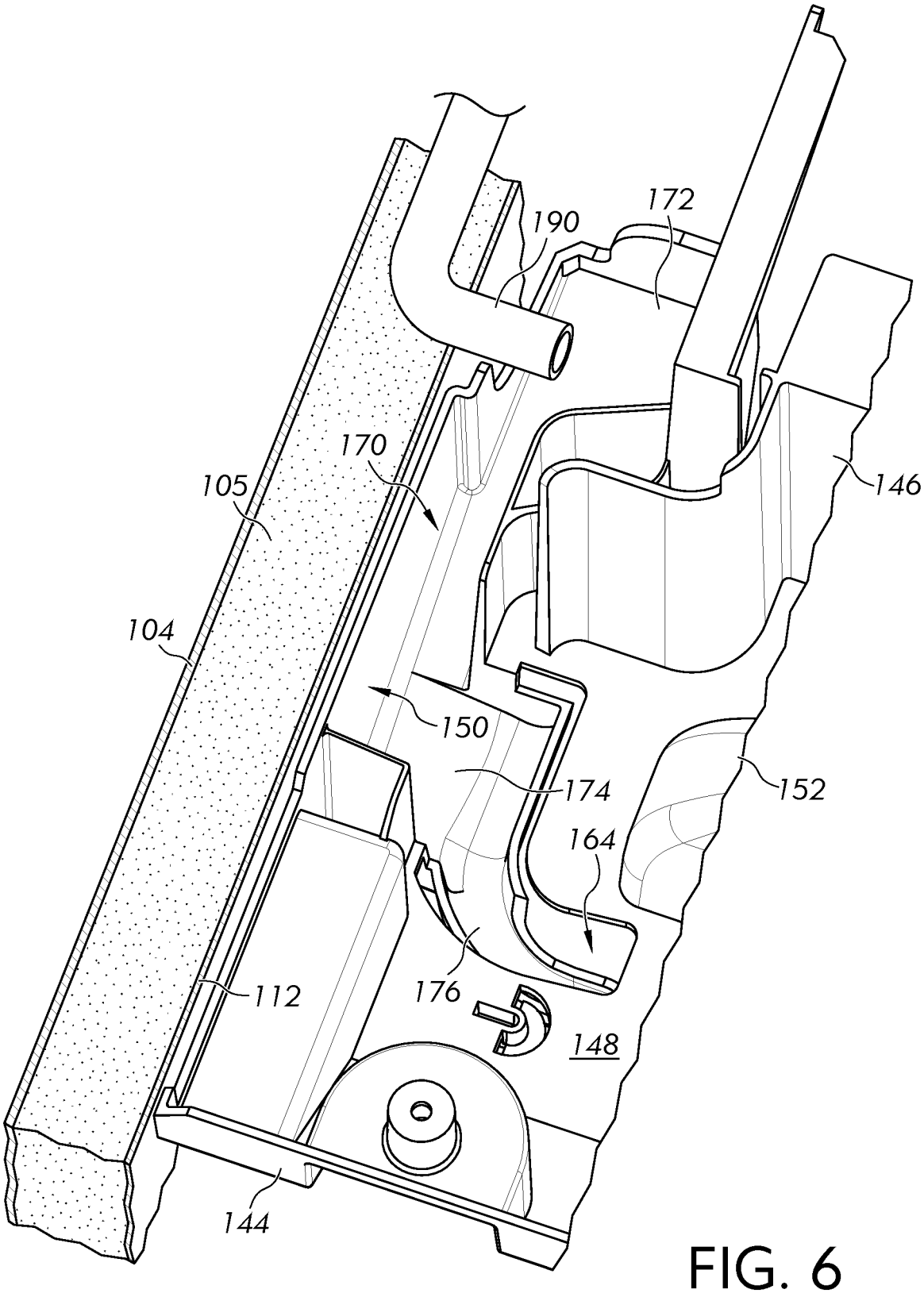
FIG. 6 is a partial, cross-sectional view of the cooling device, showing a water fill cup.

As shown in FIG. 1, the freezer 100 includes an outer cabinet 104 and an inner liner disposed therein that defines the freezer compartment 102. Specifically, the outer cabinet 104 defines an external appearance of the freezer 100 and, together with the door, conceals the freezer compartment 102 when the door is in a closed position. The outer cabinet 104 partially surrounds the liner and is laterally offset therefrom such that a space is defined therebetween. Foam insulation 105 is provided in the space between the outer cabinet 104 and the liner (as shown in FIG. 6) to thermally isolate the freezer compartment 102 from exterior (i.e., ambient) temperatures.

Figure 2:
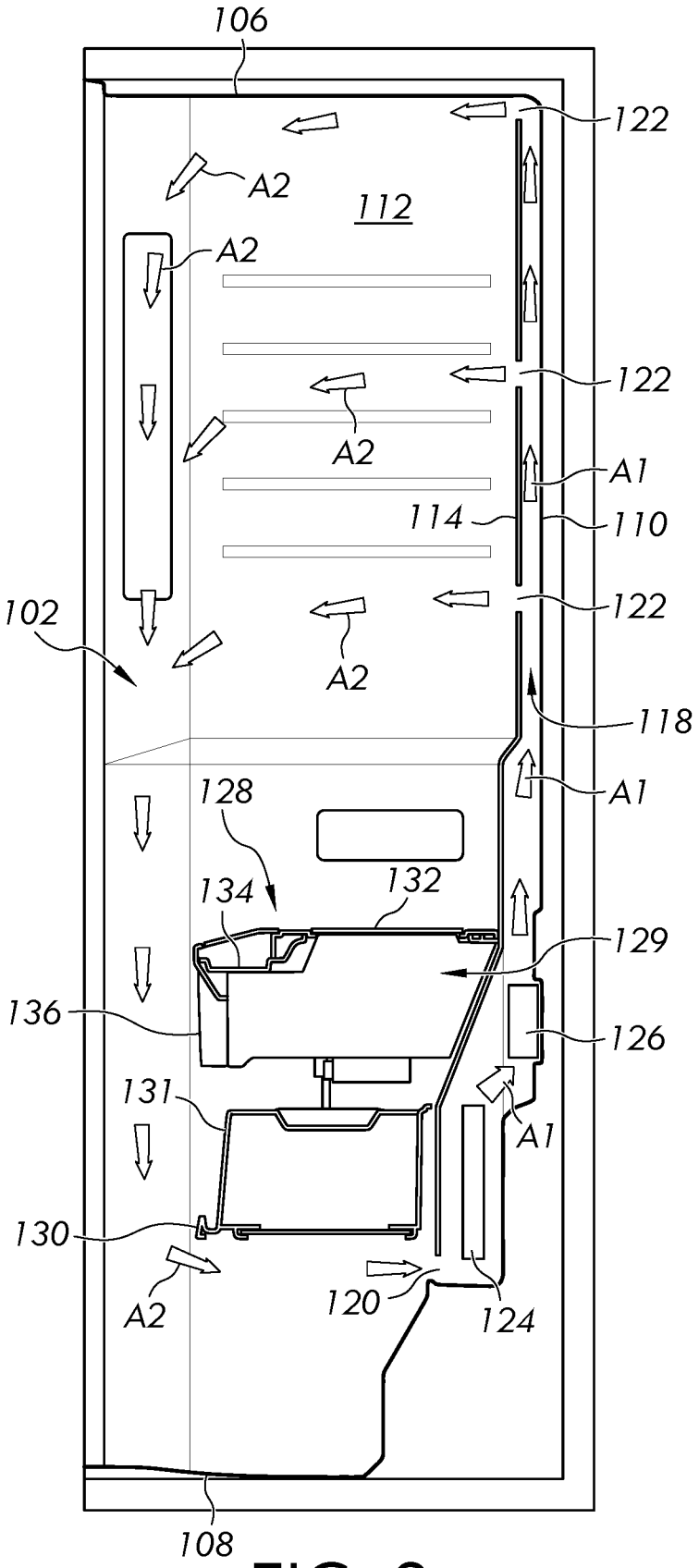
FIG. 2 is a schematic, cross-sectional view of the cooling device in FIG. 1, taken along the line 2-2.

The liner comprises a top wall 106, a bottom wall 108, a rear wall 110, and a pair of opposing side walls 112, that collectively define the freezer compartment 102. As best shown in FIG. 2, a cover 114 is disposed adjacent the rear wall 110 and extends along a length thereof in a direction from the top wall 106 towards the bottom wall 108. More particularly, the cover 114 is laterally spaced from the rear wall 110 towards a central area of the freezer compartment 102. In this manner, an air guide 118 is defined within the freezer compartment 102 and is configured to promote the circulation of air therein.

As shown, the air guide 118 is defined between the cover 114 and the rear wall 110 of the liner. The cover 114 can be a single, continuous panel extending in the direction shown in FIG. 2. Alternatively, the cover 114 can be formed via multiple, separate panels that are aligned and collectively extend in the direction shown. The cover 114 includes an inlet aperture 120 (i.e., a through-hole) and a plurality of outlet apertures 122 (i.e., through-holes) that collectively permit fluid communication throughout the freezer compartment 102. While the example shown in FIG. 2 depicts the cover 114 having only a single inlet aperture 120 and three outlet apertures 122 aligned along a vertical axis of the cover 114, it is to be understood that the cover 114 may have any number of inlet apertures 120 and outlet apertures 122. Further, it is contemplated that the inlet aperture 120 and the outlet apertures 122 may be formed in the cover 114 at any position. Moreover, it is contemplated that the inlet aperture 120 and/or outlet aperture(s) 122 need not be formed in the cover 114 (i.e., as through-holes); rather, they can be defined as spaced gaps disposed between the cover 114 and the liner.

An evaporator 124 and a freezer compartment fan 126 are disposed within the air guide 118, wherein the freezer compartment fan 126 is disposed vertically above the evaporator 124. Moreover, while not shown, EPS foam insulation can be positioned within the air guide 118 and extend vertically above the freezer compartment fan 126. The EPS foam insulation can have predefined channels (i.e., formed therein prior to installation) that efficiently guide a flow of air within the air guide 118 and out of the various air discharge ducts. The EPS foam insulation can form one or more air plenums that guide the cold air through the air guide 118. The evaporator 124 and the freezer compartment fan 126 function together to circulate a flow of air within the freezer compartment 102. Specifically, in operation, the evaporator 124 cools air within the air guide 118 to produce freshly chilled air A1, and the freezer compartment fan 126 forcefully directs the freshly chilled air A1 upwards through the air guide 118 (i.e., in a vertical direction, towards the top wall 106 of the liner) such that the freshly chilled air A1 is expelled from the air guide 118 and into the central area of the freezer compartment 102 via the outlet apertures 122.

Thereafter, the freshly chilled air A1 is directed across the freezer compartment 102 (i.e., in a direction towards a front opening of the liner) and mixes with the air already present in the freezer compartment 102 in order to reduce or maintain the overall temperature therein. After the freshly chilled air A1 mixes with the air already present in the freezer compartment 102 and/or provides heat transfer with items stored within the freezer compartment 102, the freshly chilled air A1 becomes used air A2, which circulates downwards towards the bottom wall 108 of the liner. The used air A2 then flows into the air guide 118 via the inlet aperture 120 to become cooled by the evaporator 124, and is thus recycled into freshly chilled air A1.

For purposes of the disclosures set forth herein, the term "freshly chilled air" is defined as a portion of the air within the freezer compartment 102 that has been cooled via the evaporator 124, but has not yet been exposed to the already present air within the central area of the freezer compartment 102. In contrast, the term "used air" is defined as a portion of the air that is already present within the central area of the freezer compartment 102, or the resultant mixture between the freshly chilled air A1 expelled from the air guide 118 and the air already present within the central area of the freezer compartment 102.

As shown, the freezer compartment 102 has a generally "open" configuration such that there is uninterrupted air flow throughout the entire freezer compartment 102. That is, air flow is free to travel throughout the entire freezer compartment 102 in an unrestricted manner (i.e., there are no structural barriers that divide the freezer compartment 102 into separately defined compartments, each receiving a designated air flow). Accordingly, the entire freezer compartment 102 is substantially maintained at the desired operational temperature via a single air flow circulation.

Moving back to FIG. 1, a first shelf 128, a second shelf 130, an ice maker assembly 129, and an ice bin 131 are all disposed within the freezer compartment 102. The first and second shelves 128, 130 are configured to enhance organization and storage capacity within the freezer compartment 102. In particular, the first and second shelves 128, 130 extend in a depth direction of the freezer compartment 102 (i.e., between the rear wall 110 of the liner and the front opening of the liner) and between the opposing side walls 112 of the liner. As shown, each of the first and second shelves 128, 130 extends completely from one of the opposing side walls 112 to the other. However, it is contemplated that the first shelf 128 and/or the second shelf 130 can extend between the opposing side walls 112 without contacting both or either of the opposing side walls 112.

The first shelf 128 is positioned at a spaced location from the second shelf 130 in a vertical direction (i.e., along the vertical axis of the cover 114). Said differently, the first shelf 128 is disposed vertically above the second shelf 130 at a spaced location therefrom. In particular, the first shelf 128 is disposed at a generally middle portion of the freezer compartment 102, in the vertical direction. That is, the first shelf 128 is disposed between the top wall 106 and the bottom wall 108 of the liner, without being in contact with either the top wall 106 or the bottom wall 108.

Further, the first and second shelves 128, 130 are secured to the opposing side walls 112 of the liner via fasteners (not shown). However, it is to be understood that the first shelf 128 and/or the second shelf 130 need not be secured (i.e., anchored) to the opposing side walls 112. Rather, it is contemplated that the first and/or second shelves 128, 130 may rest on respective supports (i.e., lugs, protrusions formed in the liner, etc.) such that the first and/or second shelves 128, 130 can be readily removed from the freezer compartment 102. Moreover, as will be discussed further below, a rear of the first shelf 128 is spaced from the cover 114 such that a gap 133 is formed therebetween (shown in FIG. 8).

As best shown in FIG. 2, the first shelf 128 includes a storage surface 132 and a support surface 134 that face the top wall 106 and the bottom wall 108 of the liner, respectively. That is, the storage surface 132 and the support surface 134 are generally top and bottom surfaces of the first shelf 128, respectively. However, this need not be the case, as the support surface 134 could be a surface of the first shelf 128 other than the top surface. The storage surface 132 is configured to receive and directly support food articles to be stored within the freezer compartment 102. Further, as will be discussed below, the support surface 134 is configured to support the ice maker assembly 129. Moreover, the second shelf 130 is configured to receive and hold the ice bin 131 thereon at a location directly below the ice maker assembly 129. Furthermore, the first and/or second shelf 128, 130 can include sliding and/or rotating components, generally known in the art.

Briefly moving back to FIG. 1, the ice maker assembly 129 is shown as disposed beneath (and attached to) the first shelf 128 and is substantially concealed by a shield 136. Specifically, the shield 136 is disposed in front of the ice maker assembly 129 and is configured to at least partially conceal the various elements of the ice maker assembly 129 from the end user in order to improve the overall aesthetics of the freezer compartment 102. Moreover, the shield 136 likewise protects the ice maker assembly 129 from accidental damage.

Figure 3:
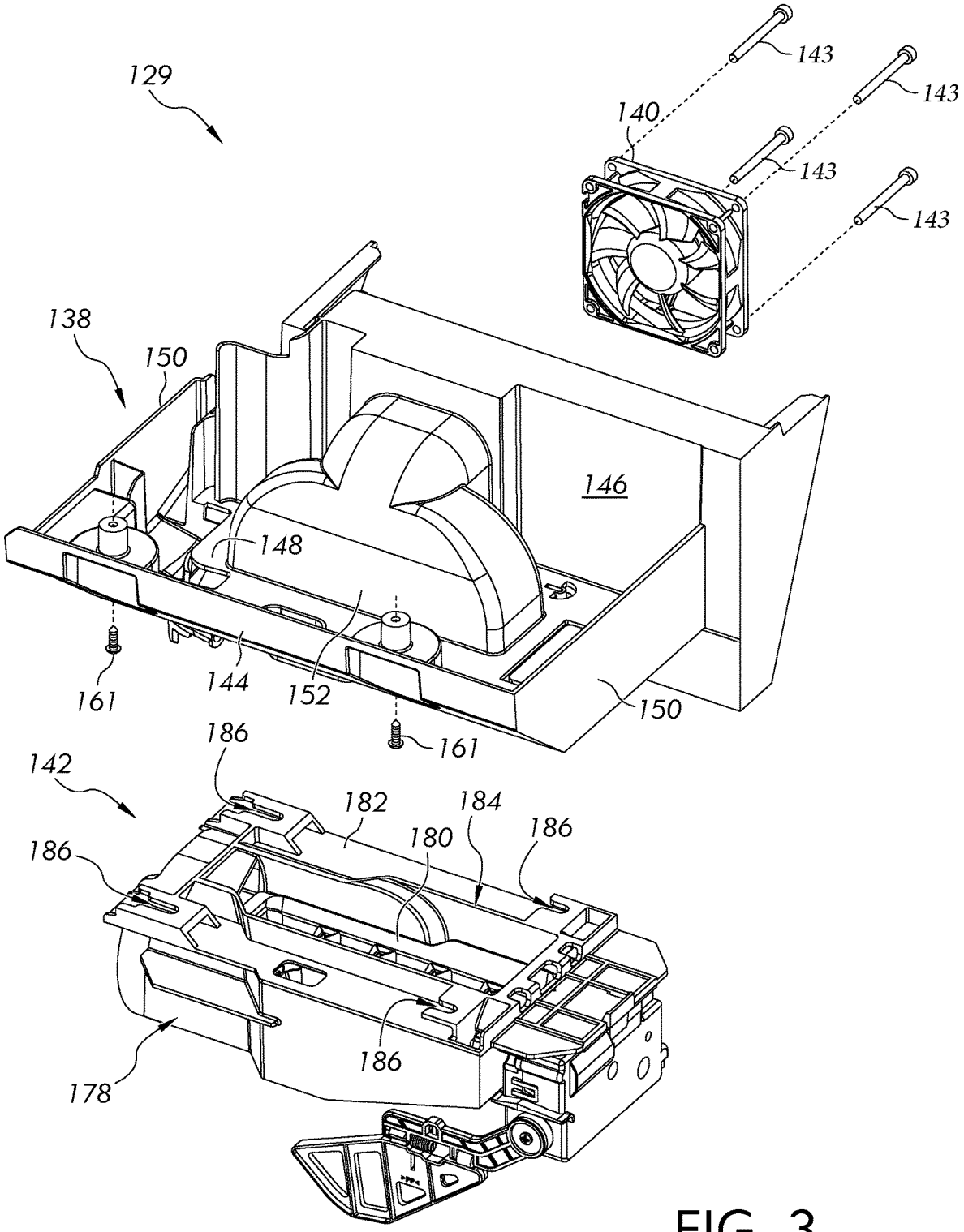
FIG. 3 is an exploded view of an ice maker assembly in FIG. 1.

Now moving on to FIG. 3, the ice maker assembly 129 is shown in an exploded view and includes an ice maker support frame 138, an ice maker fan 140, and an ice maker 142 (e.g., a twist-tray ice maker). The ice maker support frame 138 includes a front wall 144, a rear wall 146, a bottom wall 148, and a pair of opposing side walls 150 all formed integrally (i.e., during a simultaneous manufacturing process). However, it is contemplated that the front wall 144, rear wall 146, bottom wall 148, and opposing side walls 150 of the ice maker support frame 138 can be formed separate and distinct from one another and subsequently secured together. As further shown, the ice maker support frame 138 includes an air plenum 152 defining a channel 154 therein (shown in FIG. 8). Specifically, the air plenum 152 is formed integral with the aforementioned walls of the ice maker support frame 138 (i.e., during a single manufacturing process). Alternatively, the air plenum 152 can be formed separate and distinct from the walls of the ice maker support frame 138 and subsequently secured thereto.

Figure 4:
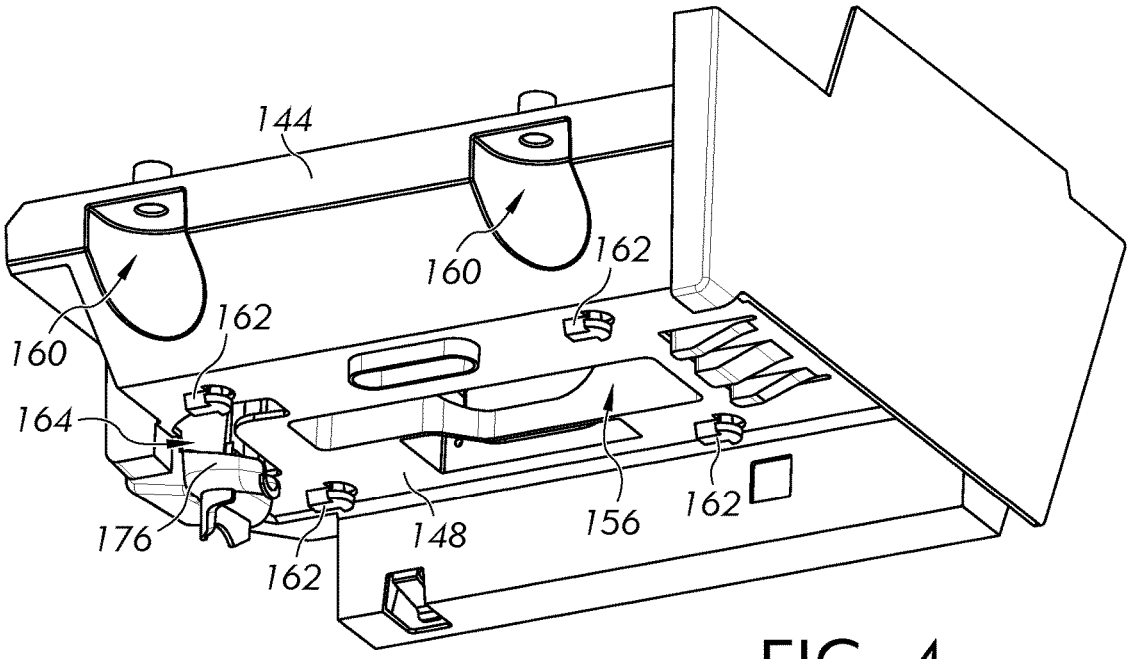
FIG. 4 is a bottom perspective view of an ice maker support frame of the ice maker assembly shown in FIG. 3.
Figure 8:
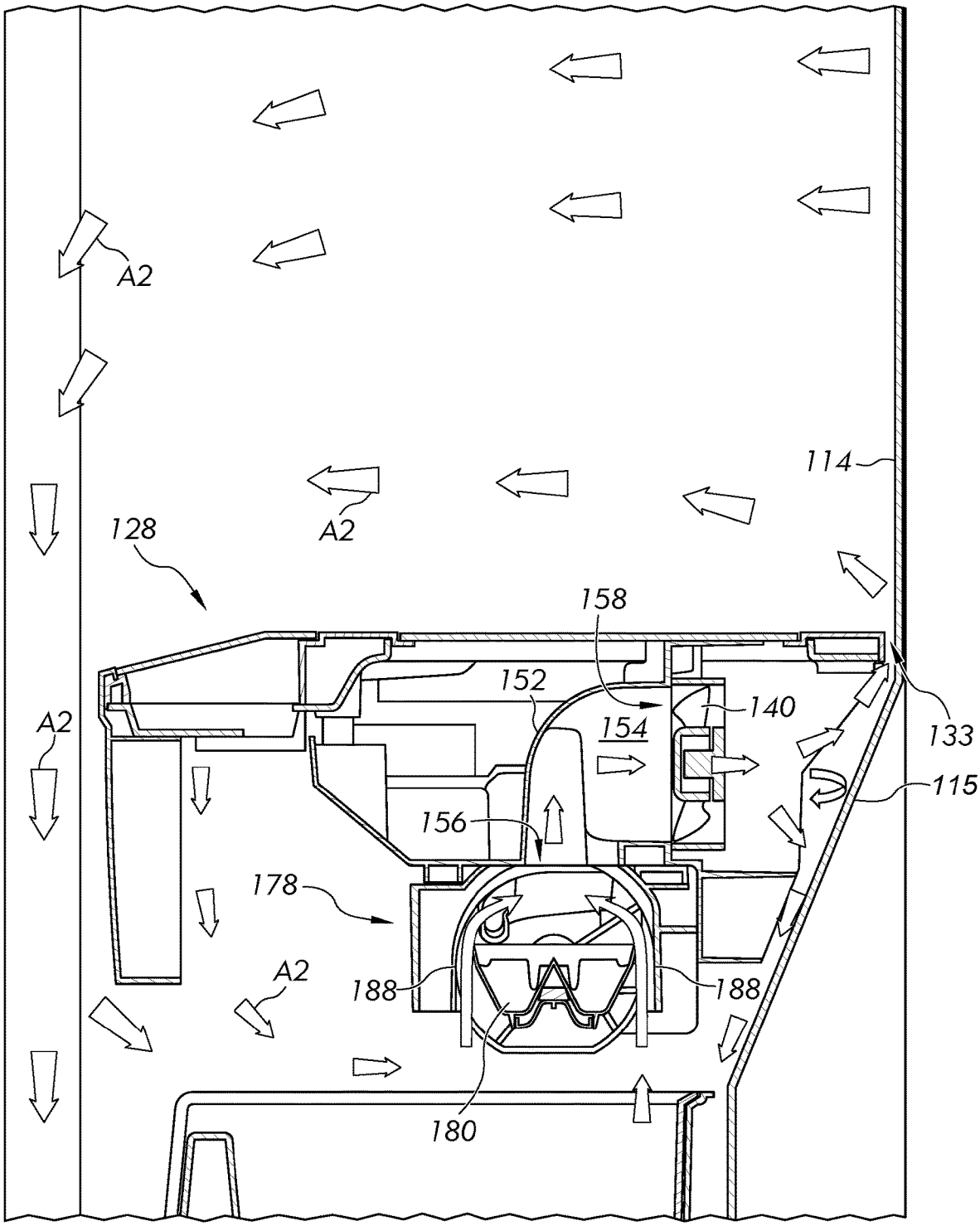
FIG. 8 is a perspective cross-sectional view of the cooling device in FIG. 1, taken along the line 8-8, excluding the outer cabinet.

As shown in FIG. 8, the air plenum 152 extends from the bottom wall 148, which can be a first wall of the ice maker support frame 138, to the rear wall 146, which can be a second wall of the ice maker support frame 138, in a generally "L" shaped manner. That is, as will be further discussed below, an air flow traveling within the channel 154 will make a 90° turn therein. Of note, while the configuration of the air plenum 152 is shown as being generally "L" shaped, this need not be the case. For example, the air plenum 152 can be configured such that the air flow traveling within the channel 154 will make an angled turn that is greater than or less than 90°. As shown in FIG. 4, the air plenum 152 includes an inlet opening 156 (i.e., a through-hole) formed in the bottom wall 148 of the ice maker support frame 138. As further shown in FIG. 5, the air plenum 152 includes an outlet opening 158 (i.e., a through-hole) formed in the rear wall 146 of the ice maker support frame 138. The channel 154 extends between the inlet opening 156 and the outlet opening 158 (as best shown in FIG. 8).

Moving back to FIG. 4, the front wall 144 includes reception areas 160 formed therein that are configured to receive fasteners 161 (e.g., bolts, screws, etc., shown in FIG. 3) that secure the ice maker support frame 138 to the first shelf 128, as will be detailed below. As further shown, a plurality of tabs 162 are formed (i.e., integral) with the bottom wall 148 of the ice maker support frame 138 and extend outwards and away therefrom. It is also contemplated that the plurality of tabs 162 may be formed separate and distinct from the bottom wall 148 of the ice maker support frame 138 and subsequently secured thereto (via fasteners, adhesives, etc.). The shown example depicts a total of four tabs 162 positioned adjacent a perimeter of the inlet opening 156; however, any number of tabs 162 may be formed with the bottom wall 148 at any location thereof. As further depicted, an aperture 164 (i.e., through-hole) is formed in the bottom wall 148 of the ice maker support frame 138 and is configured to permit guiding elements to pass therethrough to direct water to the ice maker 142, as will be discussed below.

Figure 5:
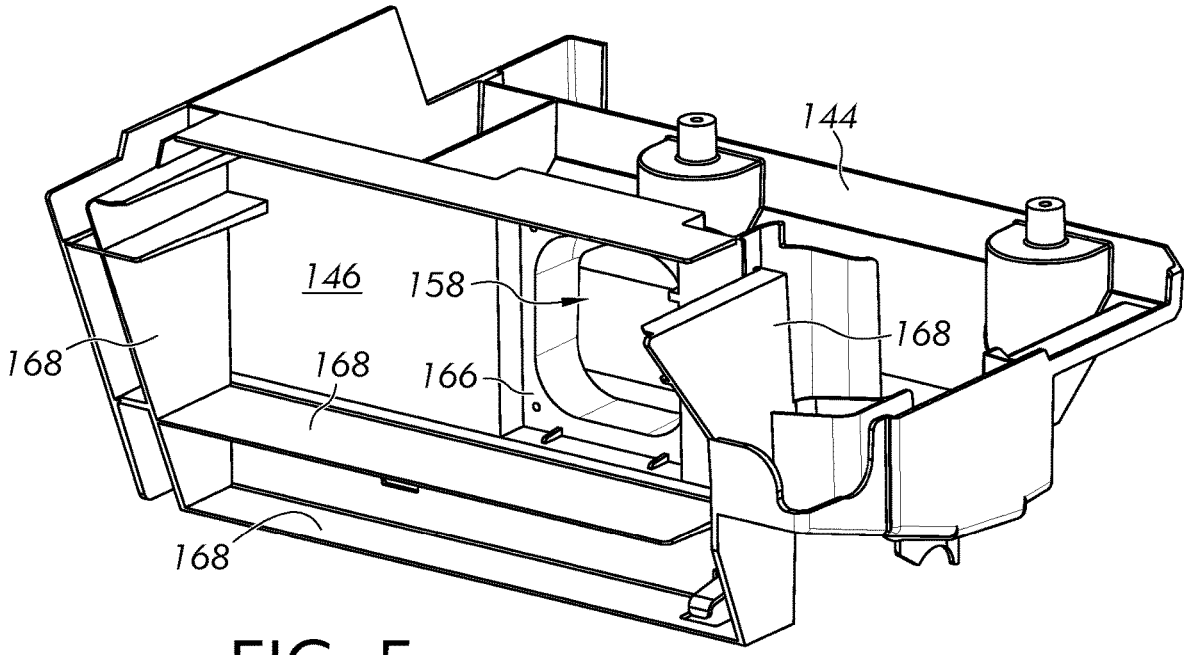
FIG. 5 is a rear perspective view of the ice maker support frame of the ice maker assembly shown in FIG. 3.

With respect to FIG. 5, the ice maker support frame 138 is shown in a rear perspective view. A recessed cavity 166 is formed in the rear wall 146 such that the recessed cavity 166 extends towards the front wall 144 of the ice maker support frame 138. In particular, the recessed cavity 166 is shaped and dimensioned so as to accept the ice maker fan 140 therein and peripherally surround an outer periphery of the ice maker fan 140, as will be detailed further below. Moreover, a plurality of support walls 168 extend outwards and away from the rear wall 146 in a direction opposite from the front wall 144 of the ice maker support frame 138. The support walls 168 are configured to brace the ice maker assembly 129 in an installed position, as will be detailed further below.

Moving now to FIG. 6, the ice maker support frame 138 further includes a fill cup 170 formed integral therewith (i.e., during a single manufacturing process). Alternatively, the fill cup 170 can be formed separate and distinct from the ice make support frame 138 and subsequently secured thereto. As shown, the fill cup 170 includes a first surface 172, a second surface 174, and a slide 176. The first surface 172 is inclined such that it slopes downwards in a direction from the rear wall 146 towards the front wall 144 of the ice maker support frame 138. The second surface 174 is located adjacent an outlet end of the first surface 172 and is inclined such that it slopes downwards in a direction from one of the opposing side walls 150 towards the air plenum 152. The slide 176 is disposed adjacent an outlet end of the second surface 174 and is inclined such that it slopes downwards from the second surface 174 towards the ice maker 142 (in an installed position).

The slide 176 is shown as being partially tube-shaped. That is, the slide 176 is depicted as being a hollow cylinder that is diametrically split. However, it is to be understood that the slide 176 can be a hollow cylinder that is not split. The first surface 172, the second surface 174, and the slide 176 collectively guide incoming water received within the fill cup 170 to the ice maker 142. More specifically, the second surface 174 and the slide 176 together define a portion of the fill cup 170 that extends through the aperture 164 formed in the bottom wall 148 of the ice maker support frame 138.

Figure 7:
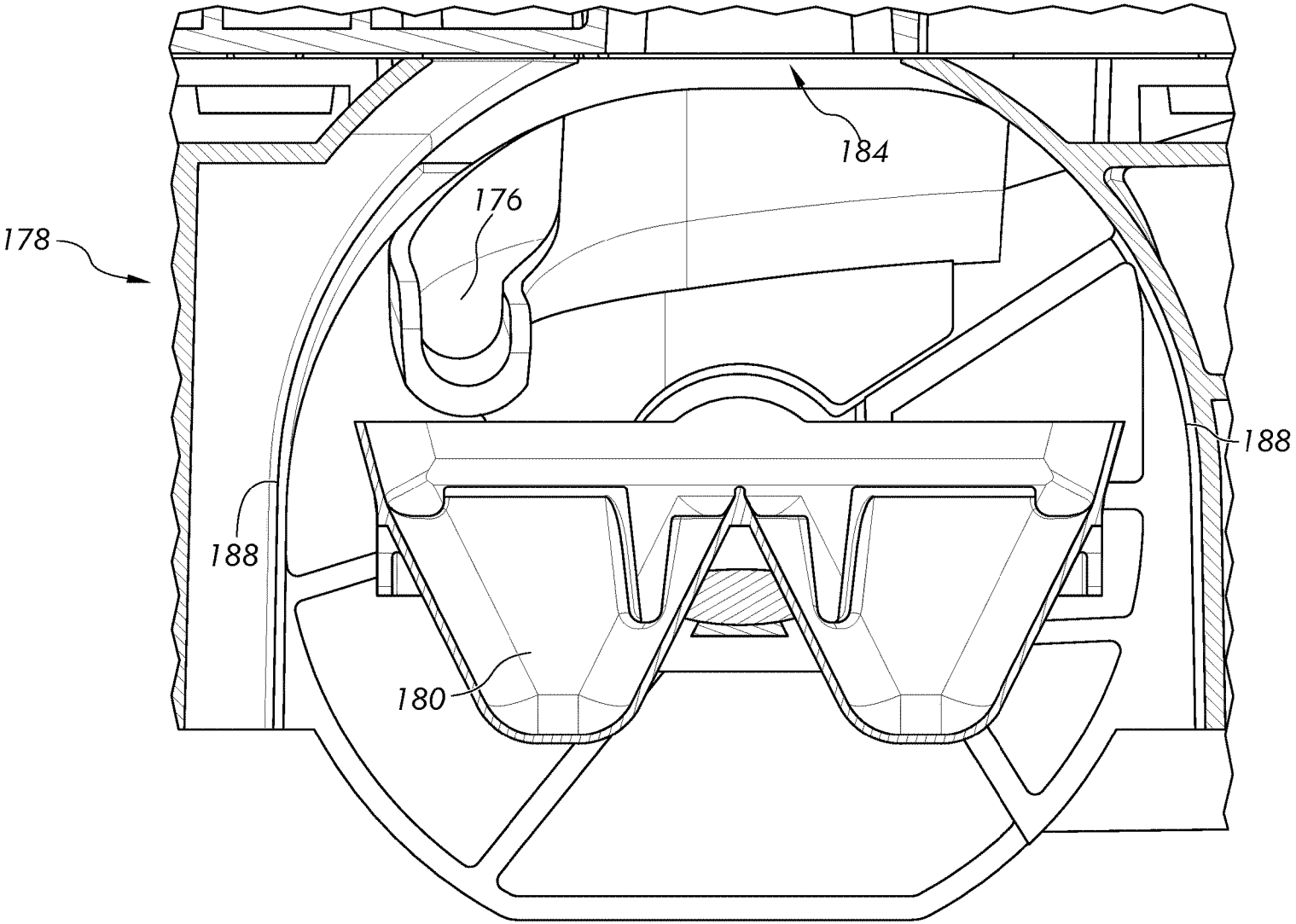
FIG. 7 is cross-sectional view of an ice maker of the ice maker assembly shown in FIG. 3.

Now moving back to FIG. 3, the ice maker 142 includes a housing 178 and an ice tray 180. The housing 178 at least partially surrounds the ice tray 180 (as shown in FIG. 7) and includes at least a top wall 182 disposed vertically above the ice tray 180 which has an opening 184 (i.e., a through-hole) formed therein. Moreover, the opening 184 has a shape generally corresponding to that of the inlet opening 156 of the air plenum 152, however it is contemplated that the shape of the opening 184 can differ from that of the inlet opening 156. The ice tray 180 is located within the housing 178 such that the opening 184 is aligned therewith in the vertical direction.

The housing 178 further includes a plurality of guide slots 186 located at the top wall 182 thereof. The guide slots 186 can be formed integral with the housing 178 (during a simultaneous manufacturing process), or separate and distinct therefrom and subsequently secured thereto. The guide slots 186 are configured to releasably engage with a respective one of the tabs 162 on the bottom wall 148 in order to secure the ice maker 142 to the ice maker support frame 138, as will be further detailed below. Moreover, it is to be understood that the amount of guide slots 186 is to equal that of the tabs 162. Further, the positioning of the guide slots 186 on the top wall 182 of the housing 178 corresponds to that of the tabs 162 on the bottom wall 148 of the ice maker support frame 138.

Further, as shown in FIG. 7, the housing 178 includes guide surfaces 188 configured to guide a flow of air around the ice tray 180, and upwards through the opening 184 (formed in the top wall 182 of the housing 178) and into the inlet opening 156 of the air plenum 152, as will be discussed below. The guide surfaces 188 are disposed at spaced locations from one another and adjacent respective, opposing sides of the ice tray 180. In this manner, the guide surfaces 188 face one another, and the ice tray 180 is disposed therebetween.

Assembly and installation of the ice maker assembly 129 will now be discussed with the understanding that the below installation/assembly steps need not be followed in the order presented. Initially, the ice maker fan 140 is placed within the recessed cavity 166 formed in the rear wall 146 of the ice maker support frame 138, such that the ice maker fan 140 is disposed directly adjacent the outlet opening 158 of the air plenum 152. Specifically, as shown in FIG. 5, the ice maker fan 140 is to be disposed within the recessed cavity 166 such that an outer periphery of the ice maker fan 140 is surrounded by a boundary wall of the recessed cavity 166. Once disposed in the recessed cavity 166, the ice maker fan 140 can be secured thereto via fasteners 143 (e.g., bolts, screws, press-fit fasteners, etc., shown in FIG. 3).

Next, the ice maker 142 is secured to the bottom wall 148 of the ice maker support frame 138. In particular, the top wall 182 of the housing 178 (shown in FIG. 3) is disposed underneath the bottom wall 148 of the ice maker support frame 138 such that the tabs 162 (shown in FIG. 4) formed on the bottom wall 148 are spaced from and align with a respective one of the guide slots 186 formed on the top wall 182 of the housing 178. Thereafter, the ice maker 142 is laterally translated such that the tabs 162 are received by a respective one of the guide slots 186, thereby securing the ice maker 142 to the ice maker support frame 138. Of note, in the installed position, the opening 184 formed in the top wall 182 of the housing 178 aligns with the inlet opening 156 of the air plenum 152. Further, in the installed position, an outlet end of the slide 176 of the fill cup 170 is disposed adjacent (e.g., laterally next to, vertically above, etc.) the ice tray 180 such that water exiting the fill cup will be received by the ice tray 180, as shown in FIG. 7 and as will be discussed further below.

As shown in FIGS. 1 and 2, the first and second shelves 128, 130 are then disposed within the freezer compartment 102 and secured to the opposing side walls 112 of the liner. Specifically, the first shelf 128 is positioned at a generally middle portion of the freezer compartment 102, in the vertical direction (i.e., between the top wall 106 and the bottom wall 108 of the liner), and the second shelf 130 is positioned vertically therebelow. As noted above, the first shelf 128 is disposed within the freezer compartment 102 such that the gap 133 (shown in FIG. 8) is formed therebetween. That is, in the installed position, the first shelf 128 is disposed within the freezer compartment 102 such that the rear of the first shelf 128 is spaced from the cover 114, thereby forming the gap 133.

After the first and second shelves 128, 130 have been installed within the freezer compartment 102, the ice maker assembly 129 is then secured to the first shelf 128. Specifically, the ice maker support frame 138 (having the ice maker fan 140 and the ice maker 142 installed thereon) is positioned directly adjacent the support surface 134 of the first shelf 128 such that the reception areas 160 align with respective fastener holes (not shown) formed in the support surface 134. In such a position, the support walls 168 of the ice maker support frame 138 contact (i.e., abut) the cover 114 (as partially shown in FIG. 8). Thereafter, fasteners are received within the reception areas 160 in order to secure the ice maker assembly 129 to the first shelf 128.

As such, in the installed position, the ice maker assembly 129 has two points of support. That is, the ice maker support frame 138 is anchored to the support surface 134 of the first shelf 128, and the support walls 168 of the ice maker support frame 138 abut against the cover 114. In this manner, the ice maker assembly 129 has a braced, cantilever design, wherein the ice maker support frame 138 is anchored at one position and supported (via abutting engagement) at a separate position. Moreover, with reference to FIG. 6, when the ice maker assembly 129 is disposed in the installed position, the fill cup 170 is disposed directly below a fill tube 190 that is retained within the foam insulation 105 and penetrates one of the opposing side walls 112 of the liner. More particularly, in the installed position, an outlet end of the fill tube 190 is positioned directly above the first surface 172 of the fill cup 170. Further still, after the ice maker assembly 129 is secured to the first shelf 128, the shield 136 can be installed in a covering manner with respect to the ice maker assembly 129.

Due to the location of the first shelf 128, the ice maker assembly 129 is likewise positioned at a generally middle portion of the freezer compartment 102, in the vertical direction (i.e., between the top wall 106 and the bottom wall 108 of the liner). This location (and the above-noted process of assembly) promotes quicker installation as well as a better experience for the end user, as the ice maker 142 being at the generally middle portion of the freezer compartment 102 makes it easier for the end user to interact therewith.

As noted above, assembly of the ice maker assembly 129 need not occur in the order disclosed above. For example, the ice maker support frame 138 can first be secured to the first shelf 128 and then the ice maker 142 can be secured to the ice maker support frame 138. Other variations of assembly steps are contemplated, and the above-noted method of assembly is not to be limited to the aforementioned disclosure.

A method of operation of the freezer 100 and the ice maker assembly 129 will now be discussed with the understanding that the below operational steps need not be followed in the order presented.

Initially, the evaporator 124 and the freezer compartment fan 126 function together to circulate a flow of air within the freezer compartment 102 so as to reduce and/or maintain a temperature of the freezer compartment 102 within the desired temperature range, noted above. Briefly, with reference to FIG. 2, the evaporator 124 cools air within the air guide 118 to produce the freshly chilled air A1. The freezer compartment fan 126 directs the freshly chilled air A1 through the air guide 118; the freshly chilled air A1 is then expelled into the central area of the freezer compartment 102 via the outlet apertures 122. The freshly chilled air A1 mixes with the already present air in the central area of the freezer compartment 102 to yield the used air A2. The used air A2 circulates downward towards the bottom wall 108 of the liner, where the used air A2 then flows into the air guide 118 via the inlet aperture 120 to be recycled into freshly chilled air A1.

When an ice making operation is requested (via a controller or user request) water is directed from an upstream source, through the fill tube 190, and into the fill cup 170. Specifically, the water is received by the first surface 172 of the fill cup 170, which directs the water towards the second surface 174 thereof. Due to the configuration and orientation of first and second surfaces 172, 174 of the fill cup 170, the water makes a generally 90° turn before it is received by the slide 176. Thereafter, the water is directed to the ice tray 180 (via the slide 176).

Before, during, or after the water fill process detailed above, the ice maker fan 140 begins operation. Specifically, with reference to FIG. 8, the ice maker fan 140 is shown as an axial fan wherein the ice maker fan 140 generates an air flow that is parallel to a rotational axis thereof. It is contemplated that other types of fans may be employed (e.g., centrifugal fans) so long as the fan functions in the same or similar manner detailed herein.

As shown, the ice maker fan 140 generates a suction force so as to direct a flow of a portion of the used air A2 to the air plenum 152. More specifically, the used air A2 is first directed into the housing 178 of the ice maker 142, wherein the guide surfaces 188 thereof guide the used air A2 around the ice tray 180 and into the inlet opening 156 of the air plenum 152. The used air A2 is routed through the channel 154 and exits the outlet opening 158 of the air plenum 152 wherein the used air A2 is received by the ice maker fan 140. The ice maker fan 140 then forcefully directs the used air A2 in a direction towards the cover 114. Subsequently, the used air A2 collides with an engagement surface 115 of the cover 114 and is dispersed in various directions. In particular, the used air A2 may be dispersed in a vertical direction (i.e., dispersed towards the top or bottom walls 106, 108 of the liner), a horizontal direction (i.e., dispersed towards the opposing side walls 112 of the liner), and/or a depth direction (i.e., dispersed towards the front opening of the liner) of the freezer compartment 102. That is, the used air A2 exits the ice maker assembly 129 and may be dispersed in all directions with respect to a rear perimeter of the ice maker support frame 138. As shown in FIG. 8, a portion of the used air A2 exiting the ice maker assembly 129 is guided (via the cover 114) through the gap 133 defined between the rear of the first shelf 128 and the cover 114. Thereafter, the used air A2 circulates back to an area disposed vertically above the first shelf 128 (and the ice maker assembly 129).

As can be seen, the ice maker fan 140 is provided fluidly downstream from the ice maker 142. Due to this relative positioning between the ice maker fan 140 and the ice maker 142, the generated air flow (of used air A2) directed through the ice maker 142 is a result of the suction force of the ice maker fan 140. Due to this directed and concentrated air flow, the air flow is more evenly distributed across the whole ice tray 180 and the amount of time it will take for the water within the ice tray 180 to freeze is decreased, thereby enhancing the overall efficiency of the ice maker 142.

Moreover, the addition of the ice maker fan 140 increases the yield of ice pieces achieved over a given time period. Specifically, the ice maker fan 140 pulls (i.e., forcefully directs the air via the suction force) cold air around the ice tray 180 to evenly cool the ice tray 180. Thus, the water stored in the ice tray 180 will freeze evenly in a direction from the bottom of the ice tray 180 to the top thereof. The configuration of the above-disclosed ice maker 142 can yield an increased ice production rate.

In short, the ice maker fan 140 generates a suction force such that an upstream flow of used air A2 is drawn in through the ice maker 142 and around the ice tray 180 (via the guide surfaces 188 of the housing 178) in an even manner. Accordingly, the water stored within the ice tray 180 will freeze in a direction generally from the bottom to the top of the ice tray 180, freezing from the exterior surface of the water in an inward direction. Moreover, while the freezer compartment 102 is already maintained within a temperature range sufficient to freeze water, the addition of the ice maker fan 140 and the air flow it generates reduces the overall time for the water to freeze, thus yielding a relatively high ice production rate over a given time period.

In addition, an ice making system designed to bring the air from the bottom can reduce the amount of hard-water minerals contained within the water that may otherwise be deposited on the inner surfaces of the ice tray cavities over time, which can eventually lead to difficulty during ice harvesting (i.e., ice cubes stuck in the ice tray). Consequently, such an ice maker design as described herein can further increase the long-term reliability of the ice maker.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An ice maker assembly for a cooling device, the ice maker assembly comprising:

an ice maker configured to produce ice pieces, the ice maker including an ice tray;

an ice maker support frame that supports the ice maker, the ice maker support frame including a fill cup and an air plenum, the fill cup configured to guide water from an upstream source to the ice tray and including a slide extending to an area disposed above the ice tray, the air plenum being disposed vertically above the ice tray and defining a channel therein and extending between first and second walls of the ice maker support frame, the channel extending between an inlet opening formed in the first wall and an outlet opening formed in the second wall, wherein the ice maker is disposed adjacent the inlet opening of the first wall; and a fan disposed at the outlet opening of the second wall, and the fan being located at a position downstream from the ice maker with respect to an air flow generated by the fan.

2. The ice maker assembly of claim 1, the second wall having a recessed cavity formed therein, the fan being disposed within the recessed cavity in an installed position thereof.

3. The ice maker assembly of claim 1, the fan generating a suction force during operation such that the flow of air is drawn through the ice maker, into the channel of the air plenum via the inlet opening, and received by the fan via the outlet opening.

4. The ice maker assembly of claim 1, the ice maker support frame including a front wall, a rear wall, a bottom wall, and a pair of opposing side walls, the first and second walls being the bottom and rear walls, respectively, the fill cup being disposed adjacent a selected one of the pair of opposing side walls.

5. The ice maker assembly of claim 4, the fill cup further including a first surface and a second surface, wherein an inlet end of the second surface is disposed adjacent the first surface, and an outlet end of the second surface is disposed adjacent the slide.

6. The ice maker assembly of claim 5, the first surface sloping downward in a direction from the rear wall towards the front wall, the second surface sloping downward in a direction from the selected one of the pair of opposing side walls towards the air plenum, and the slide extending from the outlet end of the second surface to the area disposed above the ice tray.

7. The ice maker assembly of claim 1, the ice maker further including a housing that at least partially surrounds the ice tray, the housing having a top wall disposed above the ice tray and a pair of guide surfaces being disposed below the top wall and adjacent respective sides of the ice tray, the top wall having an opening formed therein.

8. The ice maker assembly of claim 7, the top wall of the housing being attached to the first wall of the ice maker support frame such that the opening of the housing is aligned with the inlet opening.

9. The ice maker assembly of claim 7, the top wall of the housing having guide slots that selectively receive respective tabs extending outwards from the first wall in order to secure the ice maker to the ice maker support frame.

10. The ice maker assembly of claim 7, the fan generating a suction force during operation such that the flow of air is drawn through the ice maker, into the channel of the air plenum via the inlet opening, and received by the fan via the outlet opening.

11. The ice maker assembly of claim 1, the fill cup and the air plenum both being formed integral with the ice maker support frame.

12. A cooling device comprising:

a liner defining a freezer compartment;

a shelf disposed within the freezer compartment and having a storage surface and a support surface, the storage surface configured to receive and support food items thereon, and the support surface facing a direction opposite from that of the storage surface; and an ice maker assembly secured to the support surface of the shelf, the ice maker assembly comprising:

an ice maker configured to produce ice pieces; and an ice maker support frame that supports the ice maker, the ice maker support frame including a fill cup and an air plenum, the ice maker support frame being attached to the support surface of the shelf, the fill cup including a first surface, a second surface, and a slide, collectively configured to guide water from an upstream source to an ice tray of the ice maker, the first surface and the second surface being sloped in different directions, the second surface being disposed between the first surface and the slide.

13. The cooling device of claim 12, further comprising a water fill tube extending through a side wall of the liner, an outlet end of the water fill tube being disposed vertically above the fill cup.

14. The cooling device of claim 13, the outlet end of the water fill tube being disposed vertically above the first surface of the fill cup, and the slide being disposed vertically above the ice tray.

15. The cooling device of claim 14, the ice maker support frame including a front wall and an opposing rear wall, the first surface of the fill cup sloping downward in a direction from the rear wall towards the front wall, and the second surface of the fill cup sloping downward in a direction from the side wall of the liner towards the air plenum.

16. The cooling device of claim 12, the ice maker support frame including a rear wall and a bottom wall, the air plenum defining a channel therein that extends between an inlet opening formed in the bottom wall and an outlet opening formed in the rear wall.

17. The cooling device of claim 16, further comprising a fan disposed adjacent the outlet opening, the fan generating a suction force during operation such that an air flow is drawn through the ice maker, into the channel via the inlet opening, and received by the fan via the outlet opening.

18. The cooling device of claim 17, the ice maker comprising a housing and the ice tray, the housing having guide surfaces disposed adjacent respective sides of the ice tray, wherein the guide surfaces are configured to guide the air flow being drawn through the ice maker such that the air flow is directed around the sides of the ice tray.

19. The cooling device of claim 12, wherein the air plenum is disposed vertically above the ice tray.

20. A cooling device comprising:

a liner defining a freezer compartment, the liner including a top wall, a bottom wall, a rear wall, and a pair of opposing side walls;

a cover disposed adjacent the rear wall of the liner and extending between the top wall and the bottom wall of the liner, an air guide being defined as a space between the cover and the rear wall of the liner;

an evaporator disposed within the air guide;

a first fan disposed within the air guide at a location vertically above the evaporator, the first fan directing freshly chilled air, cooled by the evaporator, through the air guide and into a central area of the freezer compartment where the freshly chilled air mixes with used air already present in the central area;

a water fill tube configured to guide water therein, the water fill tube extending through a selected one of the pair of opposing side walls of the liner;

a shelf disposed within the freezer compartment and extending between the opposing side walls of the liner, the shelf having a storage surface and a support surface, the storage surface configured to receive and support food items for storage; and an ice maker assembly secured to the support surface of the shelf, the ice maker assembly comprising:

an ice maker configured to produce ice pieces, the ice maker including an ice tray and a housing at least partially surrounding the ice tray, the housing including a top wall and a pair of guide surfaces, the top wall being located above the ice tray and having an opening formed therein, the pair of guide surfaces being disposed adjacent respective sides of the ice tray;

an ice maker support frame attached to the support surface of the shelf, the ice maker support frame including a bottom wall, a rear wall, an air plenum, and a fill cup, the fill cup configured to receive water from the water fill tube and guide said water to the ice tray, the air plenum being disposed vertically above the ice tray and defining a channel therein that extends between an inlet opening formed in the bottom wall of the ice maker support frame and an outlet opening formed in the rear wall of the ice maker support frame, the top wall of the housing being attached to the bottom wall of the ice maker support frame such that the opening of the housing is aligned with the inlet opening; and a second fan disposed at the outlet opening, the second fan generating a suction force during operation such that a flow of the used air is drawn through the ice maker, into the channel of the air plenum via the inlet opening, and received by the second fan via the outlet opening.

* * * * *